United States Patent [19]

Vargas

[11] 3,956,784

[45] May 18, 1976

[54] PORTABLE BED CANOPY

[76] Inventor: Joe M. Vargas, 1551 Madison Ave., Oakland, Calif. 94612

[22] Filed: Jan. 2, 1975

[21] Appl. No.: 538,198

[52] U.S. Cl. ..... 5/362; 135/5.2

[51] Int. Cl.[2] ..... A47C 29/00

[58] Field of Search ..... 248/354 R; 160/126, 160/330; 5/10, 333, 362; 312/3, 258; 108/107

[56] References Cited

UNITED STATES PATENTS

| | | | |
|---|---|---|---|
| 1,876,061 | 9/1932 | Kirsch | 160/126 |
| 3,333,808 | 8/1967 | Du Boff | 248/354 R |
| 3,600,728 | 8/1971 | Kinzel | 5/362 |
| 3,741,225 | 6/1973 | Gunter | 5/362 |
| 3,868,081 | 2/1975 | Morgan et al. | 108/107 |

*Primary Examiner*—Casmir A. Nunberg
*Attorney, Agent, or Firm*—Theodore J. Bielen, Jr.; Richard Esty Peterson

[57] ABSTRACT

A portable bed canopy adjustable for any size bed, the canopy includes four floor mounted support posts which are spring loaded to engage the ceiling for substantially rigid support of the lightweight canopy elements. The support posts include height adjustable brackets which support upper and lower circumferential curtain rods. A canopy with a depending cloth valance is supported on the upper curtain rod and a circumferential floor length curtain is suspended on the lower curtain rod, thereby enclosing said bed.

6 Claims, 4 Drawing Figures

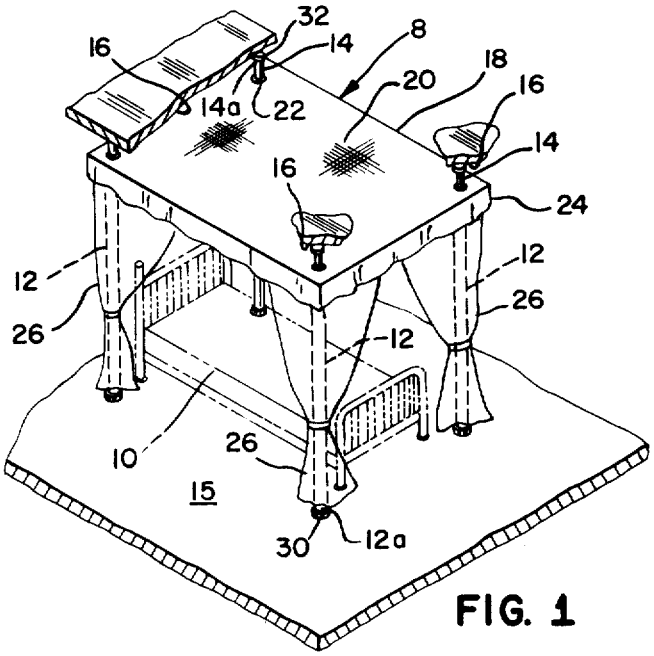
FIG. 1
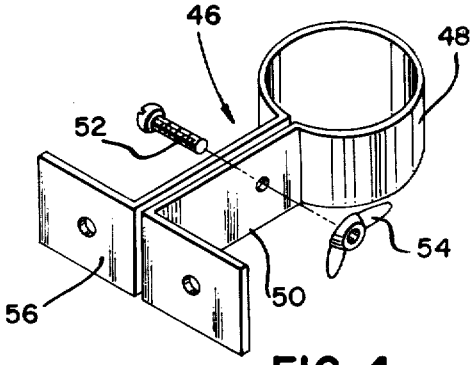
FIG. 4
FIG. 2
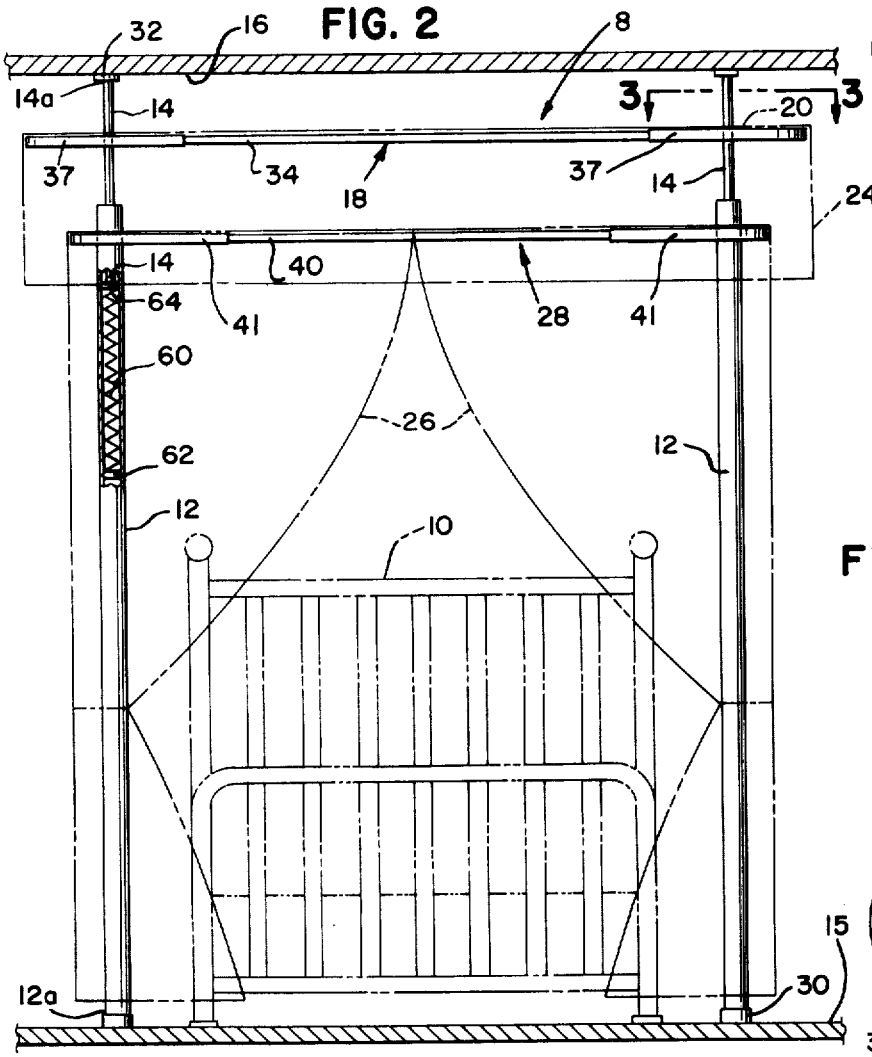
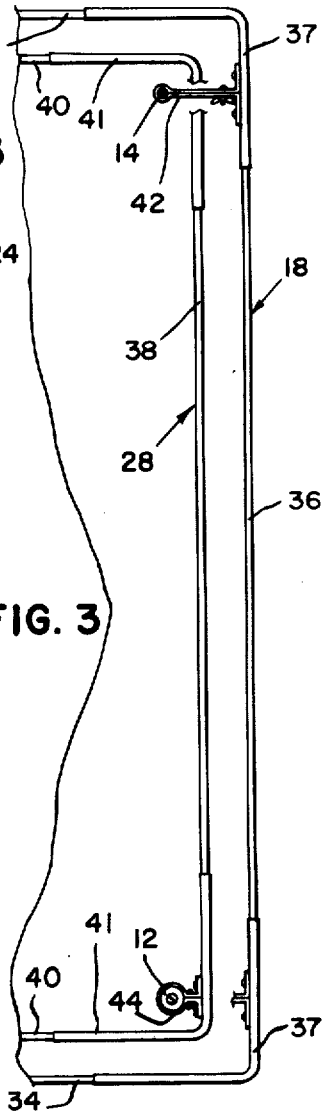
FIG. 3

PORTABLE BED CANOPY

BACKGROUND OF THE INVENTION

This invention relates to a portable bed canopy and curtain enclosure which is lightweight and adjustable for any size bed. The bed canopy is designed to be quickly and easily assembled for use or disassembled for compact storage.

Previous canopies have either been integrally a part of the original bed or have been affixed to the frame or corner posts of the bed by an adaptor means. While such canopies are adjustable and certain of such are removable, generally an attachment means adapting the canopies to the bed remains on the bed when the canopy is removed for storage. For use of the canopy on another bed, the adaptor means must be removed. This often requires the use of special tools and more than complementary exertion.

Additionally, because of the structural arrangement of a canopy supported on a bed, the frame members are frequently heavy in order to achieve the desired rigidity in the overall structure.

The portable canopy structure of the present invention is constructed to be assembled around the bed structure rather than attached thereto. In this manner, a portable bed can be removed without disturbing the canopy structure. Such a feature may be desirable in a hospital ward or other environment where beds are moveable and privacy is required for certain patients. Alternately, the portable canopy structure may be disengaged from its mounted condition and moved as an assembled unit to another location. However, the primary characteristic which makes the structure portable is the ease in which the canopy structure can be disassembled into a compact unit for transport or storage.

The lightweight characteristic of the canopy structure is achieved by the use of four corner posts which engage the floor and by spring loaded extensions which engage the ceiling to rigidly and independently fix the individual posts in position in a room. For mounting, brackets clamp to the post and support a circumferential curtain rod spacially displaced from the post. Suspended from the curtain rod is a floor length curtain which encompasses the bed. Four additional mounting brackets clamp to the spring loaded extension of the posts to support a second circumferential curtain rod above the first rod and, in turn, supports a canopy with a depending valance. The entire canopy structure is assembled around a bed without contacting the bed. In the preferred embodiment, the curtain rods are telescopically adjustable to allow the canopy structure to be adapted to a standard, queen, or king size bed by movement of the support posts and extension of the curtain rods.

BRIEF DESCRIPTION OF THE DRAWINGS

FIG. 1 is a perspective view of the canopy structure.

FIG. 2 is an elevational end view of the canopy structure.

FIG. 3 is a partially fragmented top plan view of the canopy structure taken on the lines 3—3 in FIG. 2.

FIG. 4 is a perspective view of an exemplar attachment bracket.

DETAILED DESCRIPTION OF THE PREFERRED EMBODIMENT

Referring to the perspective view in FIG. 1, the canopy structure, designated generally by the reference numeral 8, is illustrated in cooperative arrangement around a bed 10. The bed 10 is not a part of the canopy structure and is not connected thereto, but is merely illustrated for a more complete description of the function and arrangement of the canopy structure.

The canopy structure 8 is constructed with four corner posts 12, shown largely in dotted line. Each corner post 12 includes a spring loaded extension 14 which is telescopically extendable from the top end of the corner posts with an outward bias force developed by a compression spring (shown in FIG. 3). The bottom end **12*a* of the corner posts is supported on the floor 15 and the distal end 14*a* of the extension and forcefully seated against a ceiling 16**, thereby providing an independent frictional support for each post.

The posts 12 support a circumferential upper frame 18 for a canopy 20. The post extensions 14 project through a hole 22 in the corners of the canopy to engage the ceiling 16, thereby allowing the canopy to rest on the upper frame 18 which is spaced outwardly from the posts 12. The canopy 20 is sufficiently large to permit the edges of the canopy to depend from the frame 18 forming a valance 24.

A series of curtains 26, shown tied to the support posts 12, encompasses the bed 10. The curtains are suspended from a second frame 28 (shown in FIG. 2) which is mounted to the support posts 12 below and peripherally within the first frame 18.

Referring now to FIG. 2, the canopy 20 and curtain 26 are shown in phantom to more clearly illustrate the arrangement of the structural members of the canopy structure. The corner posts 12 rest on integral coasters 30 which provide a good frictional contact with the floor 15. Similarly, the spring loaded extension 14 includes a contact coaster 32 at its distal end for a frictional contact with the ceiling. The coasters are preferably of a rubber or other flexible material such that neither the floor nor the ceiling is marred by the installation of the canopy structure.

The upper frame 18 is comprised of curtain rods which are formed by straight side rods 34 and straight end rods 36 which are coupled to curved corner rods 37, as shown in FIGS. 2 and 3. The curtain rods 34 and 36 are adjustable by a conventional telescopic arrangement into the curved corner rods 37. In this manner, the overall canopy structure can be adjusted by spacial positioning of the posts 12 to accommodate beds of various sizes. While a canopy 20 is preferably supported by the frame 18 formed by the curtain rods 34, 36 and 37, a simple valance without a top covering may be supported by the frame in a similar manner.

The lower frame 28 is comprised of curtain rods 38, 40 and 41 constructed and arranged in a similar fashion as the upper frame 18. The curtain rods 38, 40 and 41 are also telescopically adjustable to permit adjustment of the overall canopy structure. The relative arrangement of the upper frame 18 and the lower frame 28 is shown with reference to FIGS. 2 and 3.

The frames are displaced from the support posts 12 by a first bracket 42 attached to the spring loaded extension 14 and the curved rods 37 and a second bracket 44 attached to the post 12 and the curved rods 41. An exemplar bracket 46 is shown in FIG. 4. The bracket 46 has a split collar portion 48 which slips over the post element. The extension portion 50 displaces the respective frame from the post. Through the extension portion is a bolt 52 and wing nut 54 which clamps the split collar porton 48 to the post element and allows for vertical adjustment of the frames on the support posts. At the end of the extension portion is the mounting portion 56 which is attached to the respective curtain rods by an appropriate fastening means (not shown). The first bracket 42 and second bracket 44 differ in the diameter of the collar portion and length of the extension portion.

Referring now to the cross-sectional portion of the post 12 in FIG. 2, a compression spring 60 is shown positioned between a stop 62 and a plunger 64 at the bottom end of the post extension 14. The compression spring 60 is longitudinally slidable in the upper end of the post 12. The bias of the extension is transmitted against the ceiling 16 and by force of friction maintains the post in position.

The canopy structure, by the variability in the effective length of the posts, is adaptable to rooms of various ceiling heights. Further, the arrangement of the curtain and canopy are adjustable by raising or lowering their support frames; and as noted above, the overall size of the canopy structure for adaptation to beds of different sizes is adjustable by telescoping the curtain rods comprising the frame.

While in the foregoing specification an embodiment of the invention has been set forth in considerable detail for purposes of making a complete disclosure thereof, it will be apparent to those skilled in the art that numerous changes may be made in such details without departing from the spirit and principles of the invention.

What is claimed is:

1. A bed enclosure comprising: four support posts vertically arrangeable proximate the four corners of a conventional bed, said support posts having a spring loaded extension element, each support post being frictionally supportable at a first end on a floor and frictionally supported at a second end on a ceiling, said extension element having a spring bias means for generating end directed forces by said support post against the floor and ceiling; a substantially rectangular frame having means for connecting said frame to each of said four support posts above the floor and means for adjusting the size and position of said frame with respect to said support posts; and, an enclosure material connected to and supported by said frame for enclosing, at least in part, the bed said four support posts and frame being free and independent of the bed.

2. The bed enclosure of claim 1 wherein said enclosure material comprises a curtain suspended from said frame.

3. The bed enclosure of claim 1 wherein said enclosure material comprises a canopy supported across said frame.

4. The bed enclosure of claim 1 comprising further an additional substantially rectangular frame having means for connecting said frame to each of said four support posts above the floor, said frame being arranged in conjunction with the frame of claim 1 wherein a first of said two frames is above and circumferentially outward from a second of said frames, said first of said frames supporting an enclosure material comprising at least a valance and said second of said frames supporting an enclosure material comprising at least a curtain.

5. The bed enclosure of claim 4 wherein said connecting means for said frames comprises brackets attachable to said frames and adjustably connectable to said posts.

6. The bed enclosure of claim 1 wherein said frame comprises curtain rods having telescopic elements for adjustment of the size of the frame.

* * * * *